US006736939B2

(12) United States Patent
Watanabe

(10) Patent No.: US 6,736,939 B2
(45) Date of Patent: May 18, 2004

(54) SHOE PRESS BELT

(75) Inventor: Kazumasa Watanabe, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 10/208,722

(22) Filed: Jul. 29, 2002

(65) Prior Publication Data

US 2003/0024677 A1 Feb. 6, 2003

(30) Foreign Application Priority Data

Jul. 31, 2001 (JP) ..... 2001-232599

(51) Int. Cl.[7] ..... D21F 3/02

(52) U.S. Cl. ..... 162/358.3; 162/358.4; 162/901; 428/217; 428/312.2; 428/314.4; 428/318.6

(58) Field of Search ..... 162/358.1, 358.3, 162/358.4, 900–904; 100/153, 155 R, 156, 173, 110, 118, 121, 122; 428/192–3, 174–5, 177, 213, 217, 304.4, 313.3, 314.2, 314.4, 312.2, 318.4, 318.6

(56) References Cited

U.S. PATENT DOCUMENTS 4,330,023 A * 5/1982 Cronin ..... 162/358.4
4,877,472 A * 10/1989 Rodal ..... 156/184
4,944,844 A * 7/1990 Marcinko ..... 162/205
5,766,421 A * 6/1998 Aufrecht ..... 162/358.4
5,943,951 A * 8/1999 Muellner et al. ..... 100/37
6,030,503 A * 2/2000 Matuschczyk ..... 162/358.4
6,042,695 A * 3/2000 Ishino ..... 162/358.4
6,116,156 A * 9/2000 Schiel et al. ..... 100/118

* cited by examiner

*Primary Examiner*—Peter Chin
*Assistant Examiner*—Eric Hug
(74) *Attorney, Agent, or Firm*—Howson and Howson

(57) ABSTRACT

In a shoe press belt, in which the nip zone is narrower than the shoe width, the shearing force which normally acts on the belt at the outer boundary of the nip zone is made either weak or non-existent by forming the outer portions of the belt of less hardness than the inner, or central, portion of the belt, so that the less hard portions can be positioned directly opposite the outer boundaries of the nip zone. Alternatively, the outer portions of the belt can be made thinner than the central portion of the belt and the thinner portions positioned directly opposite to the nip zone boundaries. The shearing force applied to the belt at the nip ends of the roll is reduced or eliminated, cracking resulting from the shear force is reduced or avoided, and a belt having improved durability results.

16 Claims, 5 Drawing Sheets

SHOE PRESS BELT

FIELD OF THE INVENTION

This invention relates to a belt for a shoe press in the press part of a papermaking machine. In particular, the invention relates to improvements in the durability of a shoe press belt.

BACKGROUND OF THE INVENTION

Shoe presses used in recent years in the press parts of papermaking machinery are classified roughly into the two types shown in FIGS. 8 and 9. Each of these shoe presses includes a press roll P and a shoe S. The shoe S has an arcuate top recess conforming with the bottom of a roll P. An endless upper felt 92 and an endless lower felt 93 run between the roll P and the shoe S, and a wet web W runs between the felts 92 and 93. An endless press belt B runs between the lower felt 93 and the shoe S, and follows the felt 93. The shoe S urges the belt B upward to press the felts 92 and 93 against the roll P. The effect of the shoe is to form a wide nip zone, which improves the water squeezing effect of the pressure exerted between the roll P and the shoe S.

The press belt B of the shoe press 91 shown in FIG. 8 is relatively long, and runs under constant tension over guide rollers 94, there being four such guide rollers in the apparatus of FIG. 8. The press belt B of the shoe press 91 shown in FIG. 9 is relatively short, and its path is a small circle.

In general, as shown in FIG. 10, the press roll P of each shoe press 91 includes both a cylindrical central portion, and end portions P' tapering in the axial outward direction. The shoe S of each shoe press 91 has chamfered round ends S'.

In the older shoe presses of the foregoing types, the nip zone N, that is, the zone underneath the middle portion of the press roll not including the tapered end portions P', was wider than the shoe width S", the shoe width being the width of the middle portion of the shoe, not including the chamfered round ends S'. On the other hand, in some current shoe presses, as shown in FIG. 10, the nip zone N formed between the roll P and the shoe S is narrower than the shoe width S". The zones above the end portions of the shoe outside the nip zone N may be referred to as non-nip zones N'.

In the shoe press shown in FIG. 10, a shearing force acts continuously on the press belt B at the boundaries P", between the nip zone N and the non-nip zones N', at the inner ends of the tapered end portions P' of the press roll. As a result of the shearing force, cracks are liable to develop along the boundary P" in the belt B. These cracks adversely affect the durability of the press belt, making it unsuitable for long-term use.

In view of the foregoing problem, the object of this invention is to provide a durable shoe press belt, in which the shearing force acting at the boundary between the nip zone and the non-nip zones is either non-existent or sufficiently weak that it causes minimal damage to the press belt.

In accordance with the invention, a specially constructed shoe press belt is used in a shoe press which comprises a press roll and a shoe, and in which the nip zone formed between the press roll and the shoe is narrower than the shoe. In this press, therefore, there is a nip zone, and at least one non-nip zone, meeting at a boundary, which will ordinarily coincide with the outer end of a cylindrical part of the press roll. The press belt, which extends through the nip zone and the non-nip zone, has a body comprising a hard portion and a portion of less hardness, and a part of the portion of the belt having less hardness is directly opposite the boundary between the nip and non-nip zones.

In one preferred embodiment of the invention, the hard portion of the belt body comprises a high molecular weight elastic material, and the portion of the belt body having less hardness comprises a high molecular weight elastic material having a hardness less than that of the high molecular weight elastic material of the hard portion of the body.

In another preferred embodiment, the hard portion of the body comprises a dense, high molecular weight, elastic material, and the portion of the body having less hardness comprises a high molecular weight elastic material having voids formed therein.

In still another embodiment, the belt body comprises a thin portion and a thick portion, so that a part of the thin portion can be positioned directly opposite the boundary between the nip and non-nip zones.

DETAILED DESCRIPTION OF THE PREFERRED EMBODIMENTS

Embodiments of the invention are described below with reference to FIGS. 1–7.

Figure 8:
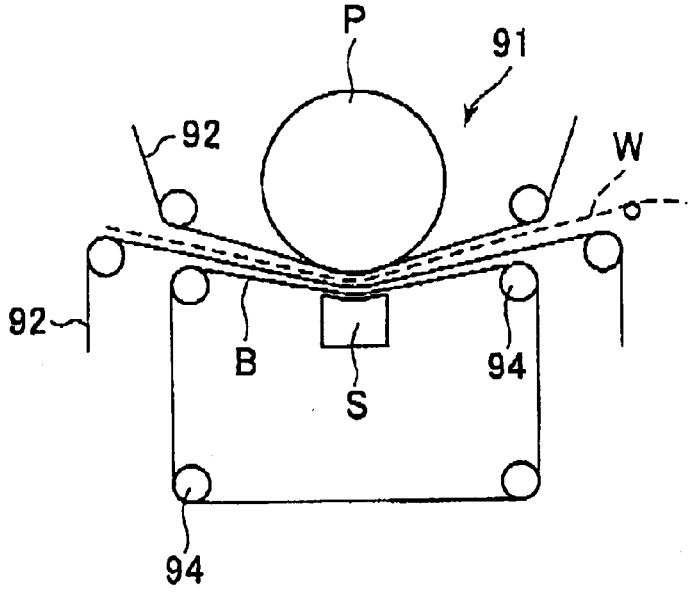
FIG. 8 is a schematic view of the main portion of a shoe press incorporating a long type shoe press belt.
Figure 9:
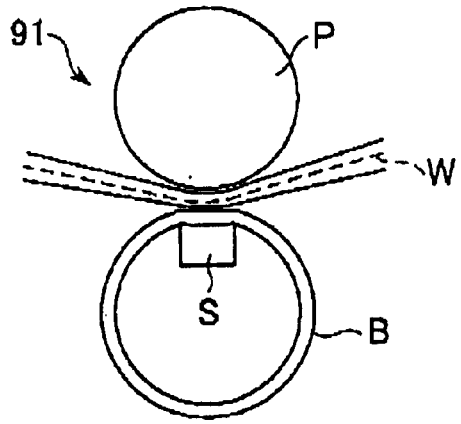
FIG. 9 is a schematic view of the main portion of a shoe press incorporating a short type shoe press belt.
Figure 10:
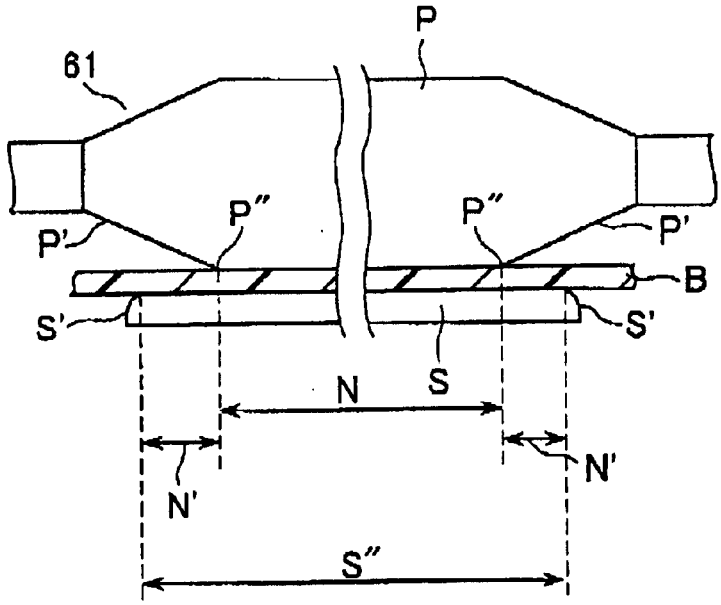
FIG. 10 is a schematic view showing the relationship of a press roll, a shoe and a shoe press belt.

Each of the belts in accordance with the invention is designed for use with one of the shoe presses 91, shown in FIGS. 8 and 9, in which the nip zone N, formed between the press roll P and the shoe S, is narrower than the shoe.

Figure 1:
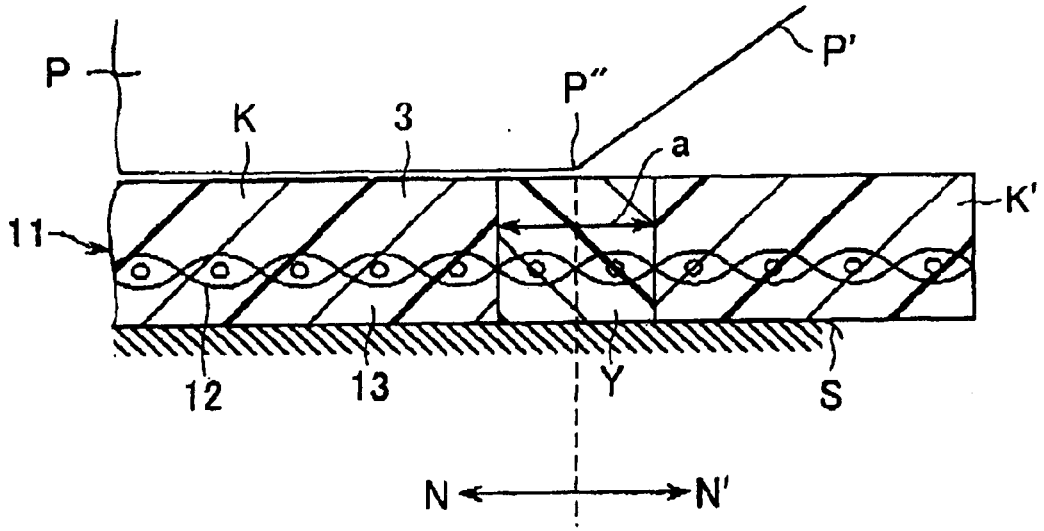
FIG. 1 is a schematic cross section of the main portion of a belt embodying the invention.

Each belt includes a body 11, as shown in FIG. 1, and, in each of FIGS. 1–4, the belt body 11 comprises a hard portion K, and a portion Y having a hardness less than that of portion K. In a typical shoe press belt in accordance with the invention, the hard portion K is a central portion, and the belt has two portions Y, having less hardness, the two portions extending along the central portion in side-by-side relationship with the central portion. The portion Y is positioned so that a part of the portion Y is directly opposite the nip end, at the boundary P" between the nip zone N and the non-nip zone N'.

Figure 5:
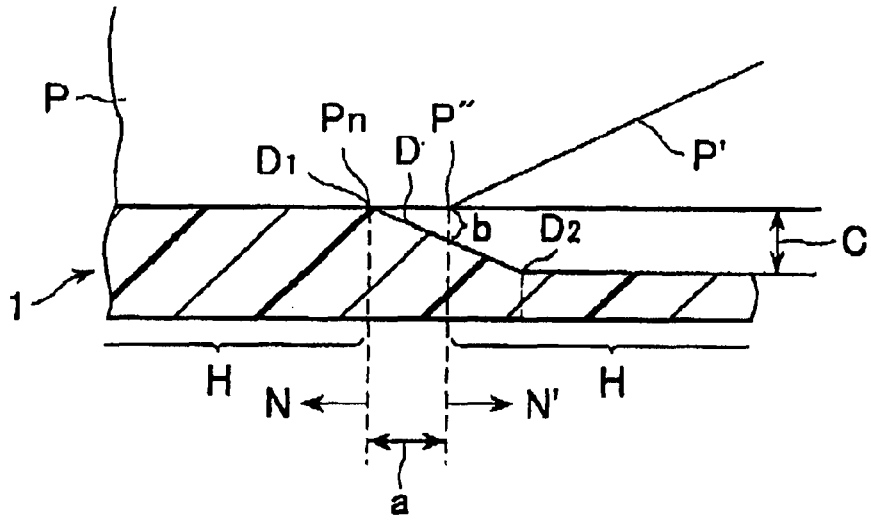
FIG. 5 is a cross section of the main portion of a belt embodying the invention, and including a thin outer portion, the belt including a tapered portion extending outward from a point located inward relative to the adjacent end of the cylindrical part of the press roll.
Figure 6:
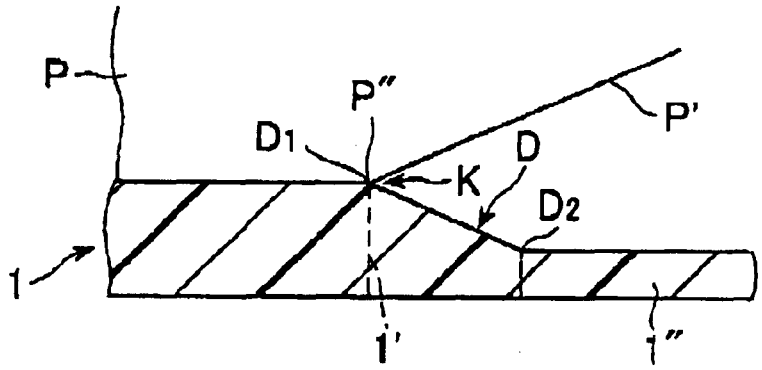
FIG. 6 is a cross section of a main portion of a belt embodying the invention, and including a thin outer portion, the belt including a tapered portion extending outward from a point coinciding with the adjacent end of the cylindrical part of the press roll.
Figure 7:
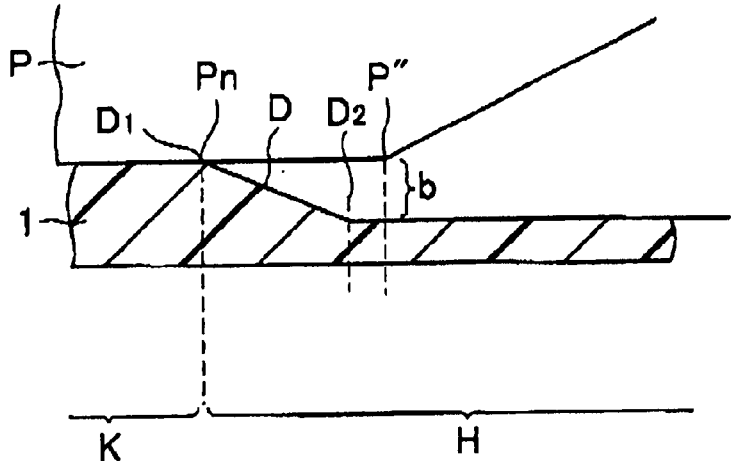
FIG. 7 is a cross section of the main portion of a belt embodying the invention, and including a tapered portion which extends from a point located inward relative to the adjacent end of the cylindrical part of the press roll. The outer edge of the tapered portion is also on the inside relative to the adjacent end of the cylindrical part of the press roll.

In each of FIGS. 5–7, the belt body 11 comprises a thin portion H and a thick portion T. The thin portion H is positioned so that a part of the thin portion is directly opposite the nip end, at the boundary P" between the nip zone N and the non-nip zone N'. Although the thick portion T is uniform in thickness, the thin portion H varies in thickness, and includes all, or at least part of, a tapered transition connecting the outer part of the thin portion with the thick portion.

As shown in FIG. 1, the belt body 11 includes a base body 12 and a high molecular weight elastic material 13. The elastic material 13 may be rubber or another elastomer, and is preferably a polyurethane resin. The base body 12 imparts strength to the belt body 11 and may be any one of a number of known structures. For example, the base body 12 may be a woven fabric having a warp and weft, a fabric formed of a warp and weft superimposed on each other, or a fabric formed from a ribbon of cloth wound in a spiral.

The belt body 11 can be produced by a process in which both sides of the base body 12 are coated and filled with a high molecular weight elastic material 13. The upper and lower layers of the elastic material 13 are joined to each other at the filling yarns (not shown) in the base body 12, and cover both sides of the base body 12. After the elastic material 13 cures, water holding grooves (not shown) may be formed in the surface of the outwardly facing elastic layer of the belt.

In accordance with a recently proposed alternative process, the belt body 11 may be manufactured by filling the base body 12 with high molecular weight elastic material 13 from only the upper side of the base body, while causing the elastic material to accumulate on both sides of the base.

Alternatively, the belt may have a high molecular weight elastic material 13 only on the press roll side of the base fabric so that base body is exposed on the shoe side. In another alternative, the belt may have a high molecular weight elastic material 13 on the press roll side of the base fabric, while the shoe-facing side may have a high molecular weight elastic material almost flush with the shoe-facing surface of the base fabric.

In FIG. 1, the belt body 11 comprises a hard portion K and a portion Y having less hardness than that of portion K. The less hard portion Y extends through distance "a", spanning the nip end of the press roll P at boundary P".

The difference in hardness between the less hard and hard portions Y and K depends on the selection of the high molecular weight elastic material. Where the belt body 11 is used at a relatively high temperature of 50° C. or more, the less hard and hard portions Y and K may be resins that soften with heat to different degrees. The difference between the degrees of softening of the two portions of the belt results in a difference in hardness between the portions Y and K when the belt is in operation. Alternatively, the portions Y and K may be made from identical materials or from high molecular weight elastic materials having identical properties, including hardness. The portion Y may be made less hard by the presence of air bubbles or other voids, while the hard portion K is more dense. In this case, a difference in the mechanical structure between the portions Y and K of the belt body results in a difference in hardness.

The high molecular weight elastic material may be formed with air bubbles or other voids in it by including hollow fillers or hollow microcapsules in the material, by including a foaming agent in the material, or by introducing air bubbles into the material by means of an air mixing machine.

The diameters of the air bubbles or other voids vary with the type and hardness of the selected high molecular weight elastic material, the function of the belt, and other factors. In general, it is preferred that the diameters range from 10 to 100 $\mu$m. Experiments have verified that, where hollow fillers or the like are used to produce the voids in the less hard portion Y, the optimum ratio of the voids to the high molecular weight elastic material is achieved where the hollow fillers constitute from about 0.5 to 50 percent by weight of the material of the portion Y. In the case of air bubbles, experiments have verified that the bubbles should be present in an amount in the range from approximately 0.2 to about 30 percent by volume of the material of the portion Y.

It is preferable that the voids in the less hard portion Y be independent of each other, so that cracks do not propagate from one void to the other voids. Where the independent voids are formed by the use of hollow fillers or hollow microcapsules, the voids are more uniform in size, and consequently, a consistent quality can be more easily achieved in the less hard portion Y.

The belt body 11 may comprise an outer less hard portion Y, and a hard portion K positioned within the nip zone N of the press roll P. Alternatively, the belt body 11 may comprise a first hard portion K, a less hard portion Y and a second hard portion K'. The first hard portion K is inside the nip zone N, while at least part of the second hard portion K' is within the non-nip zone N'. The latter form of belt is preferred for use in a shoe press requiring that the belt edges be strong when the belt is fitted to the press.

It is preferable that the hard portions K and K' should have a hardness between 85° and 98° (JIS-A). It is also preferable that the less hard portions Y should have a hardness between 80° and 95° (JIS-A). The difference in hardness between the hard and less hard portions K (and K') and Y should preferably range between about 1 and about 5 degrees. These preferred ranges of hardness and the preferred differences between the hardnesses of the hard and less hard portions have been verified by experiment.

Figure 2:
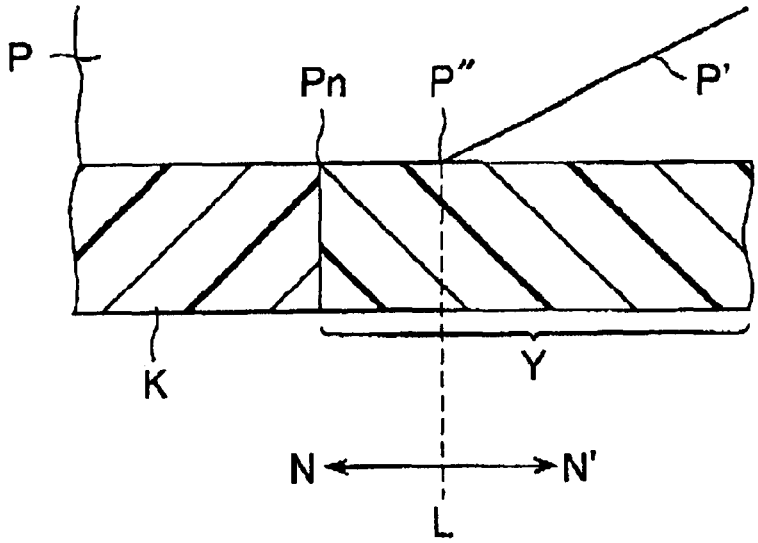
FIG. 2 is a cross section of the main portion of a belt embodying the invention which includes a hard inner portion and an outer portion of less hardness, the outer portion extending outward from a point slightly inward relative to the adjacent end of the cylindrical part of the press roll.

FIG. 2 shows a belt comprising an outer, less hard portion Y and an inner, hard portion K. The boundary between the hard portion K and the less hard portion Y of the belt is located at a point Pn to the inside of the nip end boundary P" of the press roll P. Thus, the less hard portion Y spans the boundary P" at the adjacent nip end.

Figure 3:
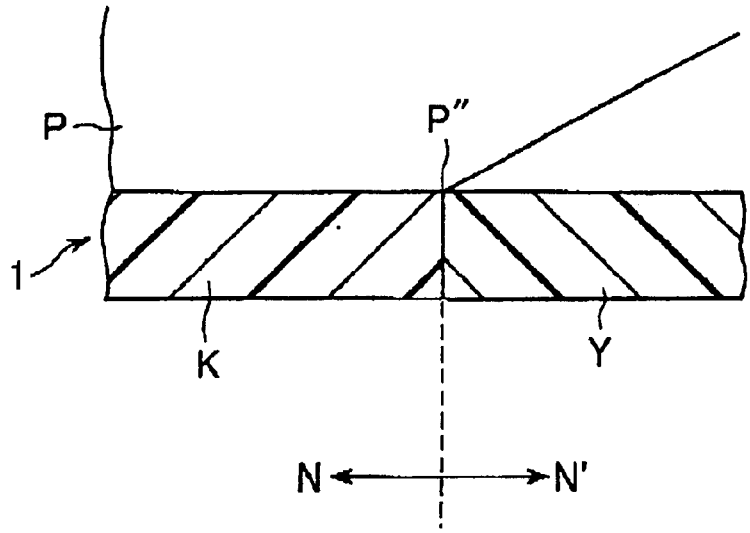
FIG. 3 is a cross section of the main portion of a belt embodying the invention, which includes a hard inner portion and an outer portion of less hardness, the outer portion extending outward from a point coinciding with the adjacent end of the cylindrical part of the press roll.

FIG. 3 shows another belt comprising an outer, less hard, portion Y and an inner, hard portion K. The boundary between the hard portion K and the less hard portion Y of this belt coincides with the nip end boundary P" of the press roll P. This belt is another embodiment in which the less hard portion Y is directly opposite the nip end boundary P".

Figure 4:
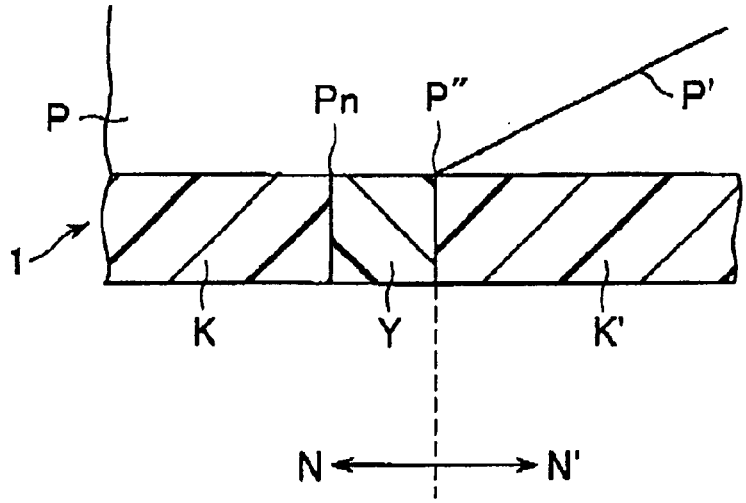
FIG. 4 is a cross section of the main portion of a belt embodying the invention, which includes a hard inner portion and a portion of less hardness, extending from a point slightly inward relative to the adjacent end of the cylindrical part of the press roll, to the outer end of the cylindrical part of the press roll.

FIG. 4 shows a belt comprising a first hard portion K, a less hard portion Y, and a second hard portion K'. The first hard portion K is to the inside on the belt relative to the less hard portion Y. The boundary between the first hard portion K and the less hard portion Y of this belt is located at a point Pn to the inside of the nip end boundary P". The boundary between the less hard portion Y and the adjacent second hard portion K' coincides with the adjacent nip end boundary P".

In the embodiments shown in FIGS. 1–4, each of the hard and less hard portions K (and K') and Y may be uniform in hardness. Alternatively, there may be hardness gradients at the boundaries between the portions K (and K') and Y.

FIGS. 5–7 show belt bodies 11 each comprising an outer thin portion H and an inner thick portion T, where part of the thin portion is directly opposite to the nip end boundary P" between the nip zone N and the non-nip zone N'.

In FIG. 5, the inner thick portion T extends to a point Pn, which is to the inside of the adjacent nip end boundary P" of the press roll P. From point Pn, the belt is tapered at D from an edge D1 to an edge D2. From edge D2 outward, the belt is of a uniform thickness less than that of thick portion T. The outer thin portion H includes not only the outer portion of uniform thickness, but also a part of the tapered portion of the belt. In this embodiment, the belt is out of direct contact with the nip end of the belt.

In FIG. 6, the belt includes a tapered portion D between the inner thick portion T and an outer thin portion of uniform thickness. The tapered portion D extends from edge D1, which coincides the adjacent nip end boundary P" of the press roll P, to edge D2. In this case, the thin portion of the belt includes the entire tapered portion. Because the tapered portion D begins at a point coinciding with the adjacent nip end boundary P", a shearing force exerted by the roll P will have less effect on the belt than it would if the belt were of uniform thickness throughout its width.

In FIG. 7, the belt also includes a tapered portion D between the inner thick portion of the belt and an outer portion of uniform thickness less than the thickness of the inner thick portion. The tapered portion D extends from edge D1, at a point Pn to the inside of the adjacent nip end boundary P", to edge D2. This belt is similar to that shown in FIG. 5, in that the belt is out of direct contact with the nip end of the belt. However, the belt of FIG. 7 differs from the belt of FIG. 5 in that the edge D2 of the tapered portion D in FIG. 7 is to the inside of the nip end boundary P". Accordingly, the distance "b" between the thin outer portion of the belt and the adjacent nip end boundary P" in FIG. 7 is greater than that in FIG. 5.

The angle of rake of the tapered portion D may be varied according to the hardness of the selected high molecular weight elastic material, and according to other factors, but preferably falls within the range of 0.4 and 0.5 degrees. It has been verified by experiment that the maximum thickness difference between the edges D1 and D2 of the tapered portion D is preferably about 1.5 mm.

Another belt (not shown) embodying the invention comprises a central thick portion, a thin portion in the form of a recess to the outside of the thick portion, and another outer thick portion outside the outer thin portion. The recess should be located so that a part of the recess is directly opposite the nip end boundary P".

The shoe press belt according to the invention, which is characterized by a body comprising a hard portion and a portion of less hardness, a part of the less hard portion being directly opposite the boundary between the nip and non-nip zones, has the outstanding advantage that it does not tend to form cracks even though it is subjected to a continuous shearing force due to the fact that the nip zone width is less than the shoe width.

The less hard portion of the belt, which avoids the adverse effects of the shearing force applied by the nip end of the roll, can be produced easily by utilizing different high molecular weight elastic materials for the hard and less hard portions of the belt.

Alternatively, the difference in hardness between the two portions of the belt can be achieved by utilizing a dense high molecular weight elastic material for the hard portion of the belt and forming the less hard portion from a high molecular weight elastic material having voids formed therein. In this case, the less hard portion, which avoids the adverse effects of the shearing force applied at the nip end of the press roll, can be easily produced mechanically by filling the portion of the belt which is to be less hard with air bubbles or other voids.

Finally, a similar effect can be achieved by forming the belt so that it comprises a thin portion and a thick portion, so that a part of the thin portion can be located directly opposite to the boundary between the nip and non-nip zones. In this case, the belt is either out of direct contact with the nip end of the press roll or, if in contact, not subject to severe shearing forces.

I claim:

1. A shoe press belt for use in a shoe press having a nip zone narrower than the shoe, and at least one non-nip zone meeting the nip zone at a boundary, the belt having a hard portion comprising a dense, high molecular weight, elastic material, and a portion having less hardness comprising a high molecular weight elastic material having closed voids formed therein, said hard portion and said portion having less hardness being in side-by-side relationship, whereby a part of the portion of the belt having less hardness can be positioned directly opposite the boundary between the nip and non-nip zones.

2. A shoe press belt according to claim 1, in which the high molecular weight elastic materials of said hard portion and said portion having less hardness are identical.

3. A shoe press belt according to claim 1, in which the high molecular weight elastic materials of said hard portion and said portion having less hardness have identical hardness properties, and in which the difference in hardness between said portions is due to said voids.

4. A shoe press belt according to claim 1, in which said voids are independent of one another, whereby cracks are prevented from propagating from one void to other voids.

5. A shoe press belt according to claim 1, in which said voids are formed by hollow elements from the group consisting of hollow fillers and hollow microcapsules.

6. A shoe press belt according to claim 1, in which said voids are formed by hollow fillers constituting from about 0.5% to 50% of the weight of said portion having less hardness.

7. A shoe press belt according to claim 1, in which the diameters of said voids are in the range from 10 to 100 $\mu$m.

8. A shoe press belt according to claim 1, in which said voids are air bubbles present in an amount in the range of approximately 0.2% to 30% of the volume of the material of said portion having less hardness.

9. A shoe press comprising:

a press roll and a shoe, the press having a nip zone and at least one non-nip zone, the nip zone formed between the press roll and the shoe, and being narrower than the shoe, and the nip zone and the non-nip zone meeting each other at a boundary; and a press belt extending through the nip zone and the non-nip zone;

in which the belt has a hard portion comprising a dense, high molecular weight elastic material, and a portion having less hardness comprising a high molecular weight elastic material having closed voids formed therein, in which said hard portion and said portion having less hardness are in side-by-side relationship, and in which a part of the portion of the belt having less hardness is directly opposite the boundary between the nip and non-nip zones.

10. A shoe press according to claim 9, in which the high molecular weight elastic materials of said hard portion and said portion having less hardness are identical.

11. A shoe press according to claim 9, in which the high molecular weight elastic materials of said hard portion and said portion having less hardness have identical hardness properties, and in which the difference in hardness between said portions is due to said voids.

12. A shoe press according to claim 9, in which said voids are independent of one another, whereby cracks are prevented from propagating from one void to other voids.

13. A shoe press according to claim 9, in which said voids are formed by hollow elements from the group consisting of hollow fillers and hollow microcapsules.

14. A shoe press according to claim 9, in which said voids are formed by hollow fillers constituting from about 0.5% to 50% of the weight of said portion having less hardness.

15. A shoe press according to claim 9, in which the diameters of said voids are in the range from 10 to 100 $\mu$m.

16. A shoe press according to claim 9, in which said voids are air bubbles present in an amount in the range of approximately 0.2% to 30% of the volume of the material of said portion having less hardness.

* * * * *